US006164089A

United States Patent [19]

Sweeny et al.

[11] Patent Number: 6,164,089

[45] Date of Patent: Dec. 26, 2000

[54] METHOD AND APPARATUS FOR RECOVERING XENON OR A MIXTURE OF KRYPTON AND XENON FROM AIR

[75] Inventors: William Paul Sweeny, Bethlehem; Zbigniew Tadeusz Fidkowski, Macungie, both of Pa.

[73] Assignee: Air Products and Chemicals, Inc., Allentown, Pa.

[21] Appl. No.: 09/349,895

[22] Filed: Jul. 8, 1999

[51] Int. Cl.[7] ..... F25J 1/00

[52] U.S. Cl. ..... 62/640; 62/925

[58] Field of Search ..... 62/648, 925

[56] References Cited

U.S. PATENT DOCUMENTS

| | | | |
|---|---|---|---|
| 2,545,778 | 3/1951 | Haringhuizen | 62/925 |
| 3,191,393 | 6/1965 | Dennis . | |
| 3,596,471 | 8/1971 | Streich . | |
| 3,609,983 | 10/1971 | Lofredo et al. . | |
| 3,751,934 | 8/1973 | Frischbier . | |
| 3,768,270 | 10/1973 | Schuftan . | |
| 3,779,028 | 12/1973 | Schuftan et al. . | |
| 3,944,646 | 3/1976 | Martin | 62/925 |
| 4,384,876 | 5/1983 | Mori et al. . | |
| 4,401,448 | 8/1983 | La Clair . | |
| 4,421,536 | 12/1983 | Mori et al. . | |
| 4,568,528 | 2/1986 | Cheung . | |
| 4,647,299 | 3/1987 | Cheung . | |
| 5,067,976 | 11/1991 | Agrawal et al. . | |
| 5,069,698 | 12/1991 | Cheung et al. | 62/925 |
| 5,122,173 | 6/1992 | Agrawal et al. . | |
| 5,186,007 | 2/1993 | Takano et al. | 62/925 |
| 5,309,719 | 5/1994 | Agrawal et al. . | |
| 5,313,802 | 5/1994 | Agrawal et al. . | |

OTHER PUBLICATIONS

Crown Ethers, "Cryogenic Distillation", Encyclopedia of Separation Technology, Douglas M. Ruthven–Editor, John Wiley & Sons, 1997, vol. 1.

M.Ruhemann, "The Separation of Gases", Oxford University Press, Second Edition, London 1949, pp.158.

*Primary Examiner*—Ronald Capossela

*Attorney, Agent, or Firm*—Willard Jones II

[57] ABSTRACT

Method and apparatus for recovering xenon or a mixture of xenon and krypton from air processed in a cryogenic air separation plant. An oxygen rich stream containing xenon and or krypton and xenon together with other trace impurities is subjected to a carbon dioxide and nitrous oxide removal step followed by concentration of xenon and or a mixture of krypton and xenon in a liquid fraction separated from an oxygen enriched vapor and vaporizing and recovering a xenon and or krypton and xenon mixture enriched vapor.

15 Claims, 1 Drawing Sheet

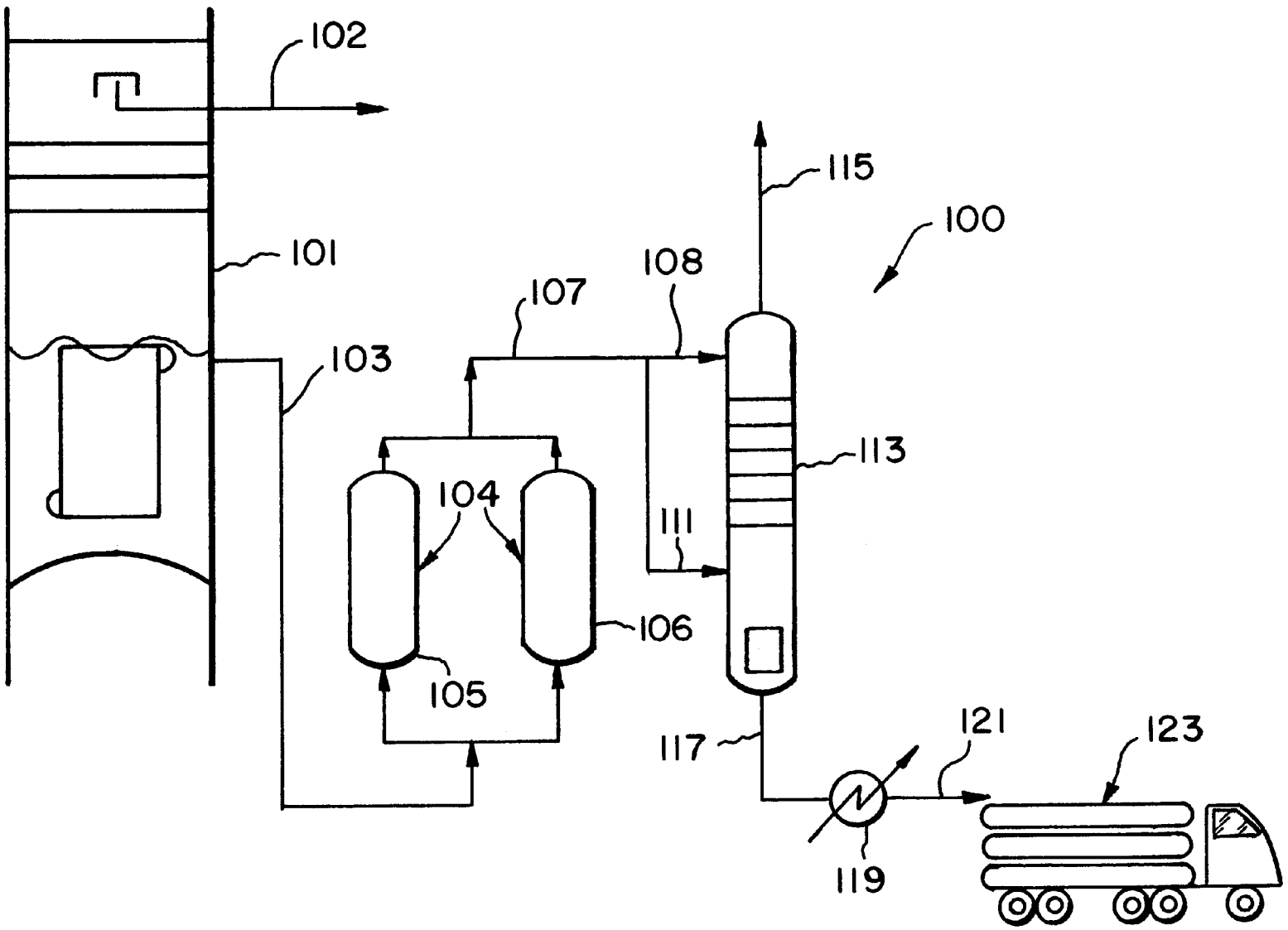
100
101
102
103
104
105
106
107
108
111
113
115
117
119
121
123

METHOD AND APPARATUS FOR RECOVERING XENON OR A MIXTURE OF KRYPTON AND XENON FROM AIR

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention pertains to economical recovery of xenon or mixtures of xenon and krypton from air processed in a cryogenic air separation plant.

The average concentration of rare gases in atmospheric air is extremely small. For example, xenon is present in amounts of about 0.09 part per million (ppm) and krypton is present in amounts of about 1.1 ppm. In order to recover xenon and/or krypton from air it is necessary to process large volumes of air. To build a facility to produce only rare gases from air would not be economical utilizing current technology.

In practice a small stream more concentrated in xenon and/or mixtures of krypton and xenon is usually withdrawn from an oxygen plant for further treatment. Due to the fact that the volatility of krypton and xenon is lower than the volatility of oxygen, the stream is usually in a form of a liquid oxygen purge. This purge stream is then further concentrated by stripping some of the oxygen in the distillation column to produce a raw xenon or krypton and xenon stream. Because the raw stream contains other non-volatile components, there are several factors limiting the maximum degree of concentration of xenon in the raw stream. These include, among others, solubility of carbon dioxide ($CO_2$), solubility of nitrous oxide (N2O) and the Lower Explosion Limit (LEL) of hydrocarbons present in the raw stream.

The raw stream is then subjected to a series of operations in order to purify the xenon or a krypton-xenon mixture completely by vaporizing the stream, treating the stream to remove hydrocarbons (usually by chemical reaction), removing carbon dioxide, $N_2O$ and water (usually by adsorption) and cooling the stream to cryogenic temperature, e.g. −290° F. (−179° C.), for final distillation.

Due to the cost of the facility to accomplish the large number of process steps that are necessary to purify xenon or a krypton-xenon mixture, xenon recovery from small and medium oxygen plants, (e.g. up to 1000 tons per day) is not economically attractive. On the other hand, the number of small and medium oxygen plants that are either existing or are in the process of being or are recently built is relatively high, with potentially large amounts of xenon and/or krypton and xenon that are not presently being recovered. Therefore, it is the primary objective of the present invention to provide an economically attractive way to recover xenon and/or krypton and xenon from existing oxygen plants.

There is no disclosure in the prior art concerning the issues of economics of producing xenon and/or krypton-xenon mixtures as a function of the size of an air separation plant. In all of the prior art related to xenon or krypton-xenon mixture recovery, it is assumed that a recovery and purification system has to be built. The prior art describe only technical details and possible advantages of various recovery systems.

U.S. Pat. No. 3,191,393 describes a krypton/xenon separation and process consisting of an initial (raw) distillation column, a catalytic reactor, carbon dioxide separator and dryer, a batch distillation device and the necessary heat exchangers.

A similar process, with an additional distillation column for rejection of methane, is disclosed in U.S. Pat. No. 4,421,536.

U.S. Pat. No. 3,596,471 discloses a process for recovering a mixture of krypton and xenon from air with an argon stripper. Other parts of the process include hydrocarbon reactor, a $CO_2$ separator and dryer, and a continuous distillation column for final purification.

Patentees in U.S. Pat. No. 3,609,983 disclose a krypton-xenon recovery system using a two-stage distillation process, hydrocarbon contaminant removal by adsorption and catalytic combustion with the resultant water and carbon dioxide be frozen out in heat exchangers.

U.S. Pat. No. 4,384,867 describes a more complex process for recovery of krypton and xenon, where, in addition to krypton and xenon a liquid oxygen stream is produced and an argon recycle stream is used to provide the necessary heat for rectification.

U.S. Pat. Nos. 4,401,448 and 5,067,976 disclose air separation processes for the production of krypton and xenon where the raw mixture from the first distillation column is further concentrated using a mixing column with a feed that also contains nitrogen. Therefore, the rare gases (together with hydrocarbons) are concentrated safely in a nitrogen environment, instead of oxygen.

U.S. Pat. Nos. 3,751,934; 3,768,270; 3,779,028; 4,586,528; 4,647,229; 5,122,173; 5,309,719; and 5,313,802 disclose various methods for removing hydrocarbons so they will not concentrate in to great of quantity with krypton and xenon in the bottom of the raw column. Concentration control is realized by reducing the reflux ratio in the raw distillation column by replacing the single feed to the column with various combinations of multiple feeds and/or bypasses. This permits most of the methane to be stripped and leave the raw column with the top vapor while krypton and xenon are retained in the bottom product. Also hydrocarbon adsorbers are discussed for removal of heavier hydrocarbons.

None of the prior art describes an economical process for recovery xenon and/or mixtures of krypton and xenon from small and medium size oxygen plants.

SUMMARY OF THE INVENTION

The present invention pertains to a method and apparatus for recovering xenon or a mixture of krypton and xenon from air by removing at least one oxygen-enriched stream from an air separation plant, the oxygen stream containing in addition to krypton and xenon carbon dioxide, nitrous oxide, nitrogen, argon, and hydrocarbons, removing the carbon dioxide and nitrous oxide from the stream and thereafter concentrating the xenon or a mixture of krypton and xenon by one of, partial evaporation, partial condensation or distillation to produce an oxygen-enriched vapor stream and a xenon or krypton-xenon enriched stream, vaporizing the liquid to produce a vapor enriched in xenon or a krypton-xenon mixture, collecting the enriched vapor and transporting the enriched vapor to a central purification facility for final treatment.

Therefore, in one embodiment the present invention is a method for recovering one of xenon or a mixture of krypton and xenon from a cryogenic air separation plant during liquefaction and distillation of air comprising the steps of: removing at least one oxygen rich stream containing one of xenon or a mixture of krypton and xenon, together with minor amounts of carbon dioxide, nitrous oxide, hydrocarbons, argon, nitrogen; treating the stream to remove carbon dioxide and nitrous oxide therefrom; subjecting the stream after carbon dioxide and nitrous oxide removal to a further processing step, being one of, partial evaporation, partial condensation, or distillation to produce an oxygen enriched vapor stream, a liquid stream rich in one of xenon or a mixture of krypton and xenon and lean in one of carbon dioxide, nitrous oxides or mixtures thereof; and subjecting the liquid stream rich in xenon or a mixture of krypton and xenon to a vaporization step to recover a vapor enriched in one of xenon or a mixture of krypton and xenon.

In another embodiment, the present invention is a method for recovering one of xenon or a mixture of krypton and xenon from a stream of liquid oxygen containing, in addition to one of xenon and a mixture of krypton and xenon, trace amounts of argon, nitrogen, carbon dioxide, nitrous oxide, and hydrocarbons comprising the steps of: removing carbon dioxide and nitrous oxide from the stream of liquid oxygen; subjecting the stream of liquid oxygen, after carbon dioxide and nitrous oxide removal, to a further processing step being one of partial evaporation, partial condensation, or distillation to produce an oxygen enriched vapor stream, a liquid stream rich in one of xenon or a mixture of krypton and xenon; and subjecting the liquid stream rich in one of xenon or a mixture of krypton and xenon to a vaporization step to recover a vapor enriched in one of xenon or a mixture of krypton and xenon.

In yet another embodiment, the present invention is a system for recovering one of xenon or a mixture of krypton and xenon from a stream of liquid oxygen containing, in addition to one of xenon or a mixture of krypton and xenon trace amounts of one of argon, nitrogen, carbon dioxide, nitrous oxide, hydrocarbons and mixtures thereof, comprising in combination: means for removing carbon dioxide and nitrous oxide from the liquid oxygen stream; separation means to separate an oxygen-enriched vapor stream from a liquid stream enriched in xenon or a mixture of krypton and xenon, the means being one of a partial evaporation means, partial condensation means or distillation means; means to withdraw the liquid stream rich in one of xenon or a mixture of krypton and xenon from the separation means; and means to vaporize the withdrawn liquid enriched in xenon or a mixture of krypton and xenon.

BRIEF DESCRIPTION OF THE DRAWING

The single FIGURE of the drawing is a schematic representation of the method and apparatus according to the present invention.

DETAILED DESCRIPTION OF THE INVENTION

Referring to the drawing a preferred embodiment of the present invention is shown generally at 100. According to the present invention a liquid oxygen stream containing xenon or mixtures of krypton and xenon and other components, including but not limited to argon, nitrogen, carbon dioxide, nitrous oxide and hydrocarbons is withdrawn from that portion of a single or dual distallation column where there is greater than 95% oxygen in the liquid, e.g. distillation column 101 of a conventional cryogenic air separation plant. Such plants are well known in the art and are disclosed, for example, in a classic double column built by Linde in 1910 and described extensively in cryogenic literature, for example in the book "The Separation of Gases" by M. Ruhemann, Oxford University Press, Second Edition, London 1949, page 158 or in the Encyclopedia of Separation Technology, Douglas M. Ruthven-Editor, John Wiley & Sons, 1997, Vol. 1, under "Cryogenic Distillation", both references incorporated herein by reference.

The liquid oxygen stream is conducted via line 103 to a carbon dioxide and nitrous oxide removal system 104. In a preferred embodiment the carbon dioxide and nitrous oxide removal system includes a pair of cryogenic adsorption devices 105 and 106. Cryogenic adsorption systems are available from Air Products and Chemicals Inc. of Allentown, Pa.

The stream exiting the carbon dioxide and nitrous oxide removal section 104 is conducted via line 107 to a distillation column 113. The stream identified in line 107 can be divided into sub-streams shown as 108 and 111 which can be fed into different locations in the column 113. The division of stream 107 into 108 and 111 is done to adjust Liquid to Vapor (L/V) ratio in column 113. This allows for operation of column 113 in such a way that volatile hydrocarbons (methane) leave column 113 with the top vapor 115 (Liquid to Vapor ratio must be low enough). On the other hand if krypton is recovered, the L/V is high enough to prevent krypton from escaping with vapor 115. Column 113 contains mass transfer devices (such as trays or packing) corresponding to 5–10 theoretical stages.

Column 113 results in an oxygen enriched vapor being withdrawn from the top of the column in line 115. A xenon or krypton and xenon enriched liquid is withdrawn from the bottom of column 113 via line 117 and passed through a heat exchanger 119 where it is vaporized to form a gas enriched in xenon or a krypton-xenon mixture and withdrawn in line 121. The vapor in line 121 can be then collected in gas cylinders or a tube trailer such as shown as 123 for transport to a central location to further process the vapor to concentrate and/or purify xenon or a mixture of krypton and xenon for commercial uses.

Set forth in Table 1 is an example of a scheme according to the present invention utilized to recover krypton xenon and krypton from a liquid oxygen stream in an oxygen plant used to produce 700 tons per day of oxygen product.

TABLE 1

| stream | 103 | 107 | 109 | 111 | 115 | 117 | 121 |
|---|---|---|---|---|---|---|---|
| Composition (mole fraction) | | | | | | | |
| N2 | 0.0000000 | 0.0000000 | 0.0000000 | 0.0000000 | 0.0000000 | 0.0000000 | 0.0000000 |
| Ar | 0.0026135 | 0.0026135 | 0.0026135 | 0.0026135 | 0.0026153 | 0.0013030 | 0.0013030 |
| O2 | 0.9971897 | 0.9972072 | 0.9972072 | 0.9972072 | 0.9972543 | 0.9637407 | 0.9637407 |

TABLE 1-continued

| stream | 103 | 107 | 109 | 111 | 115 | 117 | 121 |
|---|---|---|---|---|---|---|---|
| KR | 0.0000362 | 0.0000358 | 0.0000358 | 0.0000358 | 0.0000048 | 0.0221172 | 0.0221172 |
| XE | 0.0000077 | 0.0000076 | 0.0000076 | 0.0000076 | 0.0000000 | 0.0054080 | 0.0054080 |
| CO2 | 0.0000004 | 0.0000000 | 0.0000000 | 0.0000000 | 0.0000000 | 0.0000000 | 0.0000000 |
| N2O | 0.0000010 | 0.0000000 | 0.0000000 | 0.0000000 | 0.0000000 | 0.0000000 | 0.0000000 |
| CH4 | 0.0001384 | 0.0001315 | 0.0001315 | 0.0001315 | 0.0001256 | 0.0043274 | 0.0043274 |
| C2H6 | 0.0000087 | 0.0000022 | 0.0000022 | 0.0000022 | 0.0000000 | 0.0015466 | 0.0015466 |
| C3H8 | 0.0000044 | 0.0000022 | 0.0000022 | 0.0000022 | 0.0000000 | 0.0015570 | 0.0015570 |
| Total Flow (lb mole/hr) | 100.00 | 100.00 | 40.00 | 60.00 | 99.86 | 0.14 | 0.14 |
| Temperature (° F.) | −289.1 | −289.1 | −289.1 | −289.1 | −293.8 | −293.1 | 70.0 |
| Pressure (psia) | 23.16 | 23.16 | 23.16 | 23.16 | 18.00 | 18.15 | 18.00 |
| Phase | liquid | liquid | liquid | liquid | vapor | liquid | vapor |

From Table 1 it is apparent that the final stream identified as 121 is enriched in both krypton and xenon which can be collected for further processing to yield a commercial product.

In the event that only Xenon is to be recovered the process and apparatus of the invention can be modified by replacing distillation column 113 with a partial vaporization device. Such devices are well known in the art.

It is also within the scope of the present invention to use partial condensation as a means for recovering the rare gas fraction from the liquid oxygen stream 107, vaporized prior to the partial condensation.

The most important benefit of the present invention is that it enables a user to recover xenon or a mixture of krypton and xenon from small and medium size oxygen plants in an economical manner. Because the carbon dioxide and nitrous oxide are removed upstream of the raw distillation column 113 krypton and xenon can be concentrated to a much higher degree than in conventional plants with the hydrocarbon contents still substantially below the Lower Explosion Limit (LEL). This enables transportation of the concentrate to be less expensive and the use of a central purification system to be economically attractive. On the other hand additional concentration of the xenon or a krypton-xenon mixture is not an important economic advantage when the mixture does not have to be transported, i.e., when the final purification plant is connected to the raw purification unit.

Having thus described our invention what is desired to be secured by Letters Patent of the United States is set forth in the appended claims, which should be read without limitation.

What is claimed:

1. A method of recovering a product containing a rare gas, wherein said rare gas is selected from the group consisting of xenon, krypton and mixtures thereof, from a cryogenic air separation plant during liquefaction and distillation of air comprising the steps of:

removing at least one oxygen rich stream containing the rare gas and minor amounts of a contaminant gas comprising of carbon dioxide and nitrous oxide;

treating said oxygen-rich stream to remove the contaminant gas;

separating said stream after removal of the contaminant gas to produce an oxygen enriched vapor stream, a liquid stream rich in the rare gas and lean in one of carbon dioxide, nitrous oxides or mixtures thereof, wherein said separation is accomplished by partial evaporation, partial condensation or distillation of said stream after removal of the contaminant gas; and vaporizing the liquid stream rich in the rare gas to recover a vapor enriched in the rare gas.

2. A method according to claim 1 including transporting said recovered vapor enriched in the rare gas to a central purification facility for processing into a commercial product.

3. A method according to claim 1 including the step of removing the contaminant gas by cryogenic adsorption.

4. A method according to claim 1 including the step of removing said oxygen rich stream from that portion of a single or dual distillation column in said air separation plant where there is greater than 95% oxygen in said stream.

5. A method of recovering a product containing a rare gas, wherein said rare gas is selected from the group consisting of xenon, krypton and mixtures thereof, from a stream of liquid oxygen containing, in addition to the rare gas, trace amounts of a contaminant gas comprising carbon dioxide and nitrous oxide comprising the steps of:

treating said oxygen-rich stream the contaminant gas;

separating said stream of liquid oxygen, after removal of the contaminant gas to produce an oxygen enriched vapor stream, and a liquid stream rich in the rare gas, wherein said separation is accomplished by partial evaporation, partial condensation or distillation of said stream after removal of the contaminant gas; and vaporizing the liquid stream rich in the rare gas to recover a vapor enriched in the rare gas.

6. A method according to claim 5 including transporting said recovered vapor enriched in the rare gas to a central purification facility for processing into a commercial product.

7. A method according to claim 5 including the step of removing the contaminant gas by cryogenic adsorption.

8. A method according to claim 5 wherein said stream of liquid oxygen is withdrawn from that portion of a single or dual column of a conventional cryogenic air separation plan where there is greater than 95% oxygen in said stream.

9. A system for recovering a product containing a rare gas, wherein said rare gas is selected from the group consisting of xenon, krypton and mixtures thereof, from a stream of liquid oxygen containing, in addition to the rare gas, trace amounts of one of a contaminant gas comprising carbon dioxide and nitrous oxide, comprising in combination:

means for treating said liquid oxygen stream to remove the contaminant gas;

separation means to separate an oxygen-enriched vapor stream from a liquid stream enriched in the rare gas, said means being a partial evaporation means, a partial condensation means or a distillation means;

means to withdraw said liquid stream from said separation means; and means to vaporize said withdrawn liquid enriched in the rare gas.

10. A system according to claim 9 wherein said means for removing the contaminant gas is a cryogenic adsorption system.

11. A system according to claim 9 wherein said separation means is a distillation column.

12. A system according to claim 9 including means to collect said vaporized liquid rich in the rare gas for transport to a processing facility.

13. An apparatus of recovering a product containing a rare gas, wherein said rare gas is selected from the group consisting of xenon, krypton and mixtures thereof, from a cryogenic air separation plant during liquefaction and distillation of air comprising in combination:

means to remove at least one oxygen rich stream containing the rare gas and minor amounts of a contaminant gas comprising of carbon dioxide and nitrous oxide;

adsorption means to remove the contaminant gas from said oxygen enrich stream;

means to separate an effluent from said adsorption means into an oxygen enriched vapor stream and a liquid stream rich in the rare gas and lean in the contaminant gas, said means being a partial evaporation means, a partial condensation means or a distillation means; and means to vaporize said liquid stream enriched in the rare gas and means to recover said vaporized stream.

14. An apparatus according to claim 13 including means to transport said recovered vapor enriched in the rare gas to a central purification facility for processing into a commercial product.

15. A method according to claim 13 wherein said means to remove said oxygen rich stream is adapted to remove said oxygen rich stream from that portion of a single or dual distallation column in said air separation plant where there is greater than 95% oxygen in said stream.

* * * * *

UNITED STATES PATENT AND TRADEMARK OFFICE

CERTIFICATE OF CORRECTION

PATENT NO. : 6,164,089

DATED : Dec. 26, 2000

INVENTOR(S) : Sweeny et al.

It is certified that error appears in the above-indentified patent and that said Letters Patent is hereby corrected as shown below:

Column 6, Line 53
Delete "plan" and substitute therefor --plant--

Signed and Sealed this

Twenty-ninth Day of May, 2001

Nicholas P. Godici

*Attest:*

NICHOLAS P. GODICI

*Attesting Officer*

*Acting Director of the United States Patent and Trademark Office*